US007934700B2

(12) United States Patent
Karatzis

(10) Patent No.: US 7,934,700 B2
(45) Date of Patent: May 3, 2011

(54) NETTING OR FENCE WITH RETRO-REFLECTIVE STRIPS

(75) Inventor: Antonios Karatzis, Crete (GR)

(73) Assignee: Koratzis S.A. (GR)

( * ) Notice: Subject to any disclaimer, the term of this patent is extended or adjusted under 35 U.S.C. 154(b) by 0 days.

(21) Appl. No.: 11/843,884

(22) Filed: Aug. 23, 2007

(65) Prior Publication Data

US 2008/0042115 A1 Feb. 21, 2008

Related U.S. Application Data

(63) Continuation of application No. PCT/EP2006/001619, filed on Feb. 22, 2006.

(51) Int. Cl.
*E04H 17/02* (2006.01)

(52) U.S. Cl. ..... 256/45; 256/1; 256/46

(58) Field of Classification Search ..... 256/19, 256/45, 46, 1

See application file for complete search history.

(56) References Cited

U.S. PATENT DOCUMENTS

| | | | | |
|---|---|---|---|---|
| 3,347,527 | A * | 10/1967 | Andrews | 256/12.5 |
| 4,626,465 | A | 12/1986 | Henningsson | |
| 5,201,497 | A * | 4/1993 | Williams et al. | 256/45 |
| 5,865,427 | A * | 2/1999 | Cowan | 256/19 |
| 6,367,781 | B1 * | 4/2002 | Flynn et al. | 256/45 |
| 6,615,757 | B2 * | 9/2003 | Ochi | |
| 2001/0033911 | A1 * | 10/2001 | Jolliffe | |
| 2004/0101653 | A1 * | 5/2004 | Beretta et al. | |

FOREIGN PATENT DOCUMENTS

| | | | |
|---|---|---|---|
| EP | 0 376 861 | | 7/1990 |
| EP | 1 422 349 | | 11/2003 |
| FR | 2713810 | A1 * | 6/1995 |
| FR | 2755901 | A1 * | 5/1998 |
| GB | 20714 | A | 9/1910 |
| GB | 2343210 | A * | 5/2000 |
| WO | WO 9831870 | A2 * | 7/1998 |
| WO | 02 06590 | | 1/2002 |

* cited by examiner

*Primary Examiner* — Victor MacArthur

(74) *Attorney, Agent, or Firm* — Mayback & Hoffman, P.A.; Gregory L. Mayback; Rebecca A. Tie

(57) ABSTRACT

A net/fence includes retro-reflective elements such as tapes that extend in horizontal and/or vertical directions with respect to the fence. The tapes are attached to the netting by thread or glue. One method for weaving the net/fence includes dragging the tape extending in a machine direction along the netting during weaving and threading the tape thereto. Another method for weaving the net/fence includes dragging the tape extending in a transverse direction and attaching the tape thereto with glue. A net-weaving machine can produce such a net in a machine direction and use a comb having threading needles to selectively attach the tape to the net with the thread. If attached in the transverse direction, a trolley borne on a beam lying in the transverse direction introduces the tape onto the net and a connection device, such as a glue jet, connects the tape to the net.

7 Claims, 7 Drawing Sheets

Fig. 1b
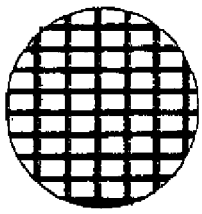
-Prior Art-
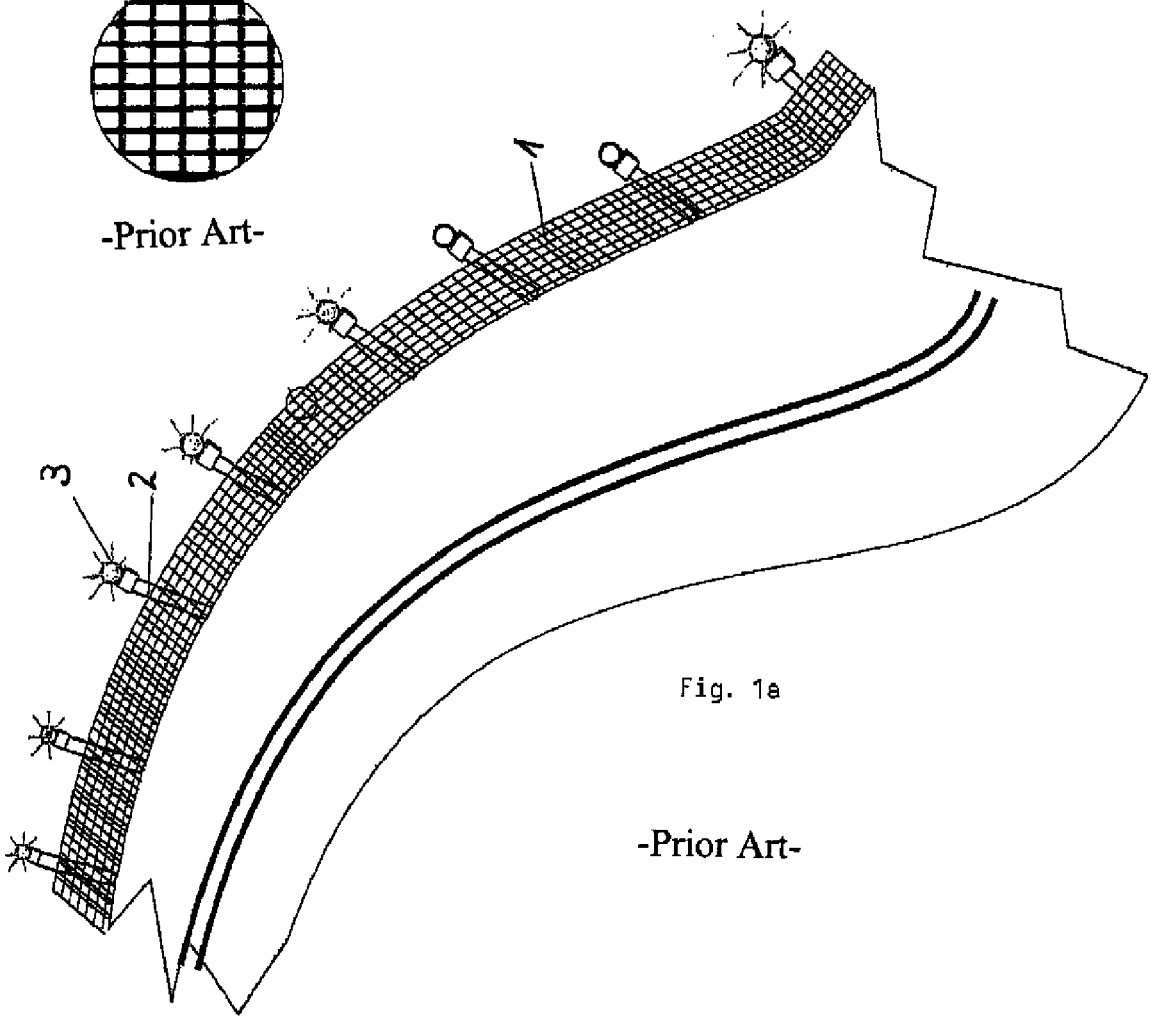
Fig. 1a
-Prior Art-

NETTING OR FENCE WITH RETRO-REFLECTIVE STRIPS

CROSS-REFERENCE TO RELATED APPLICATION

This is a continuing application, under 35 U.S.C. §120, of copending international application No. PCT/EP2006/001619, filed Feb. 22, 2006, which designated the United States; this application also claims the priority, under 35 U.S.C. §119, of Greece Patent Application Serial No. 20050100090, filed Feb. 23, 2005; the prior applications are herewith incorporated by reference in their entirety.

STATEMENT REGARDING FEDERALLY SPONSORED RESEARCH OR DEVELOPMENT n/a

FIELD OF THE INVENTION

This invention relates to the production of a new series of braided products that include interwoven reflective strips to function as warnings for imminent danger.

BACKGROUND OF THE INVENTION

As it is generally known, measures have to be taken to ensure protection of road works or various other works. For example, nets are used for safety, which nets are made of plastic or various other materials and exist in different colors. Depending on weather conditions, the nets may be difficult to be seen under existing light. For this reason, any project supervisor, e.g., of road construction, is obliged to draw attention to any imminent danger to put up special lamps, which can be battery operated or operated by a combination of other electromechanical systems. These devices, beyond their high cost of purchase, need to be maintained often and supervised to assure proper operation. Moreover, batteries are a source of considerable environmental pollution. The above-mentioned systems, not only have high operating costs, they must also be placed close together on special mountings so that people will be able to spot them easily. This increases the total operational cost even more. FIG. 1*a* shows prior art wherein a fence 1 includes a plurality of posts 2 supporting lamps 3 that illuminate the roadside. FIG. 1*b* is an enlarged portion of fence 1 as indicated in FIG. 1*a*. FIG. 1*b* is an enlarged part of the fence 1.

As for the existing mesh nettings, they are produced by extrusion and, because of this production method, their walls are thick. Therefore, the meshes produced have a small length, great weight, and are bulky.

BRIEF SUMMARY OF THE INVENTION

The invention provides a netting or fence that overcomes the hereinafore-mentioned disadvantages of the heretofore-known devices and methods of this general type and that serves to make visible boundaries of a road.

With the foregoing and other objects in view, there is provided, in accordance with the invention, a netting or fence includes fibers tied with one another and includes retro-reflective elements. The netting serves as a framework to receive the retro-reflective elements that reflect light beams emitted by the lights of a vehicle or of lights born by a person during road construction and help to increase security considerably during such works.

Preferably, the reflective elements are tapes.

In an advantageous embodiment, the reflective elements are positioned parallely or vertically with respect of the direction in which the netting is extending.

In another embodiment, it is advantageous if the reflective elements are embedded in the netting.

It is advantageous if the elements are woven in the netting, sown in the netting, or thermo glued.

In another embodiment of the invention, the fibers are woven or braided.

Preferably, the fibers are made of synthetic material.

In an advantageous embodiment, the fibers are made of or comprise polyethylene, especially low density (LLDPE) or high density polyethylene (HDPE), and/or a stressed polyethylene film, polypropylene (PP), polyvinylchloride, or ethylene vinyl acetate (EVA) or at least another similar plastic material.

Advantageously, the fibers are between 100 mm and 6000 mm in width.

Further, it is advantageous if the netting comprises reinforcement warps and/or wefts.

With the objects of the invention in view, there is also provided a fence to be erected along a road to ensure the security of persons or vehicles including the netting according to the invention.

With the objects of the invention in view, there is also provided a netting including fibers of a synthetic material tied with one another with reinforcement warps and wefts, the fibers having a width between 100 mm and 6000 mm and retro-reflective tapes at least one of embedded in the fibers, woven in the fibers, sown in the fibers, and thermo-glued to the fibers.

It is another object of the invention to provide for a method for weaving a netting that includes at least one tape, especially a retro-reflective tape.

According to the invention a method for weaving a netting or a fence is provided, where at least one tape extending in machine direction during weaving is dragged along the netting and is threaded to the netting.

According to another method of the invention, a netting or a fence is woven where at least one tape extending in transverse direction with respect to the machine direction is dragged in transverse direction and attached to the netting by a glue.

It is still another object of the present invention to provide a weaving machine adapted for methods mentioned above.

According to the invention, a weaving machine for weaving a fence or a netting that includes at least one tape extending in machine direction includes a comb with threading needles that attach the tape to the netting.

According to the invention, a weaving machine for weaving a fence or a netting that includes at least one tape extending in a transverse direction with respect to the machine direction includes a beam extending in transverse direction bearing a trolley for introducing the tape onto the netting and a device for connecting the tape to the netting.

In accordance with a concomitant feature of the invention, the weaving machine, advantageously, may include a connecting device that has at least one jet for gluing the tape to the netting.

According to the invention, synthetic plastic meshes (nettings) may be used, the number of which, the size, color, and embedding method of the retro-reflective tapes is free and defined only by the use for which the final product is intended. The synthetic mesh nettings may be produced by extrusion. The synthetic plastic meshes may be produced at any width and length. The width produced is limited only by the needs of the final user. Their length is freely defined. The synthetic plastic meshes (netting), according to the invention, may be produced in that way that their number, their size and the weaving pattern of their reinforcement warps and wefts is free and defined only by the use for which the final product is intended. In addition, the number and size of squares and their extrusion method is free and defined only by the use for which the final product is intended. The invention also pertains to synthetic plastic meshes (netting) wherein the number, the size and the manner in which retro-reflective tapes are to be embedded in them is freely defined and they are limited only by the use for which the final product is intended.

Other features that are considered as characteristic for the invention are set forth in the appended claims.

Although the invention is illustrated and described herein as embodied in a netting or fence with retro-reflective strips, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

Advantages of embodiments the present invention will be apparent from the following detailed description of the preferred embodiments thereof, which description should be considered in conjunction with the accompanying drawings, which are not true to scale, which show different exemplary embodiments of the invention, and in which:

FIG. 1*a* is a fragmentary, perspective view of a prior art fence;

FIG. 1*b* is an enlarged elevational view of part of the fence of FIG. 1*a;*

DESCRIPTION OF THE INVENTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. It must be noted that, as used in the specification and the appended claims, the singular forms "a," "an," and "the" include plural references unless the context clearly dictates otherwise.

Figure 2:
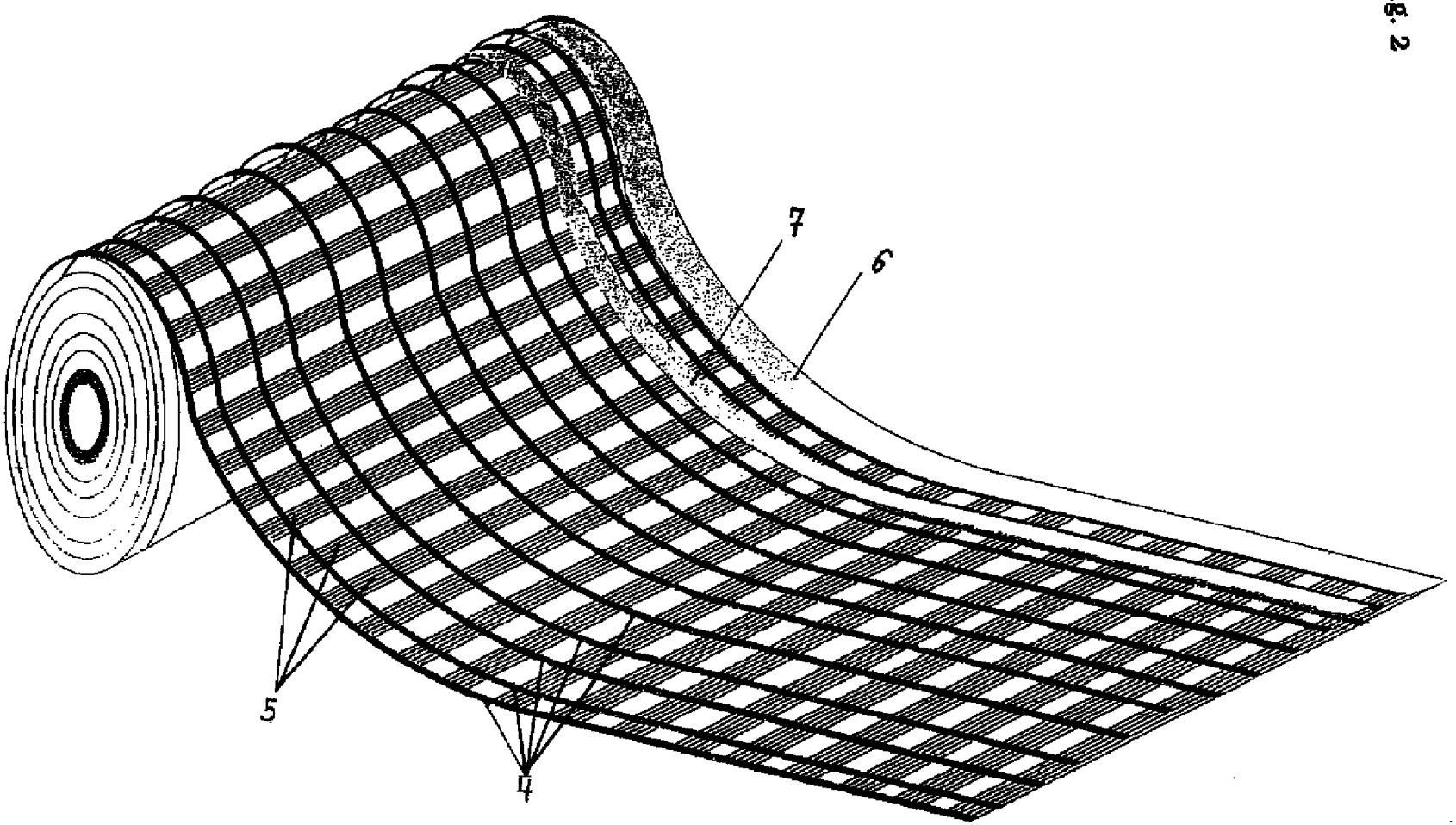
FIG. 2 is a perspective view of a roll of fence or netting according to an exemplary embodiment of the present invention including a retro-reflective tape.

Hereinafter the following definitions apply:

i. {Mesh}: Thin tapes made preferably from polyolefines such as PP (polypropylene), LLDPE (low density polyethylene), HDPE, polyvinylchloride (PVC), or ethylene vinyl acetate (EVA) or another similar plastic material. These tapes have been woven into a mesh. The dimensioning and braiding of the netting is not relevant because it is possible to be made in any desired weaving pattern and dimension.

ii. {Fibers}: The thin tapes that make up the netting. Before their final strain, they are between 15 μm and 150 μm in thickness and between 1 mm and 20 mm in width.

iii. {Warps}: Woven fibers 4 in the direction of the netting flow (FIG. 2).

iv. {Wefts}: Fibers 4 woven together with wefts 5, which combine the wefts 5 into a net (FIG. 2).

v. {Extruded}: This is a category of mesh nettings that are produced by extrusion without being woven with part or complete rotation of the die head to achieve the form of a net.

vi. {MD}: (Machine Direction) The flow direction of the mesh when it is unrolled or during production.

vii. {Retro-reflection tape or reflective tape}: Tapes that are made mostly of a polyester agent or other synthetic material and are coated with micro prisms. Depending on the application they are intended for better reflection; their background color may be orange, red, silver, or fluorescent. As for their width, it can be from 1 mm to 1000 mm. In various other products, in order to be better interwoven in the mesh, this tape is elastic, such as in hay-baling meshes. As used herein, the meaning of retro-reflective includes the so-called "cat-eye" or "red-eye" effect by which light is reflected back towards the light source.

While the specification concludes with claims defining the features of the invention that are regarded as novel, it is believed that the invention will be better understood from a consideration of the following description in conjunction with the drawing figures.

This invention refers to mesh products such as netting for fences in projects, hay-baling mesh, and other woven materials made from synthetic materials. The weaving method for the production of protective meshes has many advantages, such as better strength against breaking force compared to their very small weight per running meter. Warning mesh netting that is intended for fences for road and other works are made of woven synthetic fibers with polyolefin base. These fibers may be made from Polyethylene (PE) of high (HDPE) or low (LLDPE) density, as well as other similar synthetic materials. In these meshes it is possible—depending on the needs and the use for which they are intended—to weave reflective tapes along the length and the width of the netting retro. These nettings have a weight of 10 to 500 gr/m2.

The number of retro-reflective tapes 6, 7 (FIG. 2) is freely decided and is only defined by the length and width of each netting. In another exemplary embodiment, the netting includes warps 8 (FIG. 3) and wefts 9 wherein retro-reflective strips 10 are positioned between the warps 8.

Figure 4:
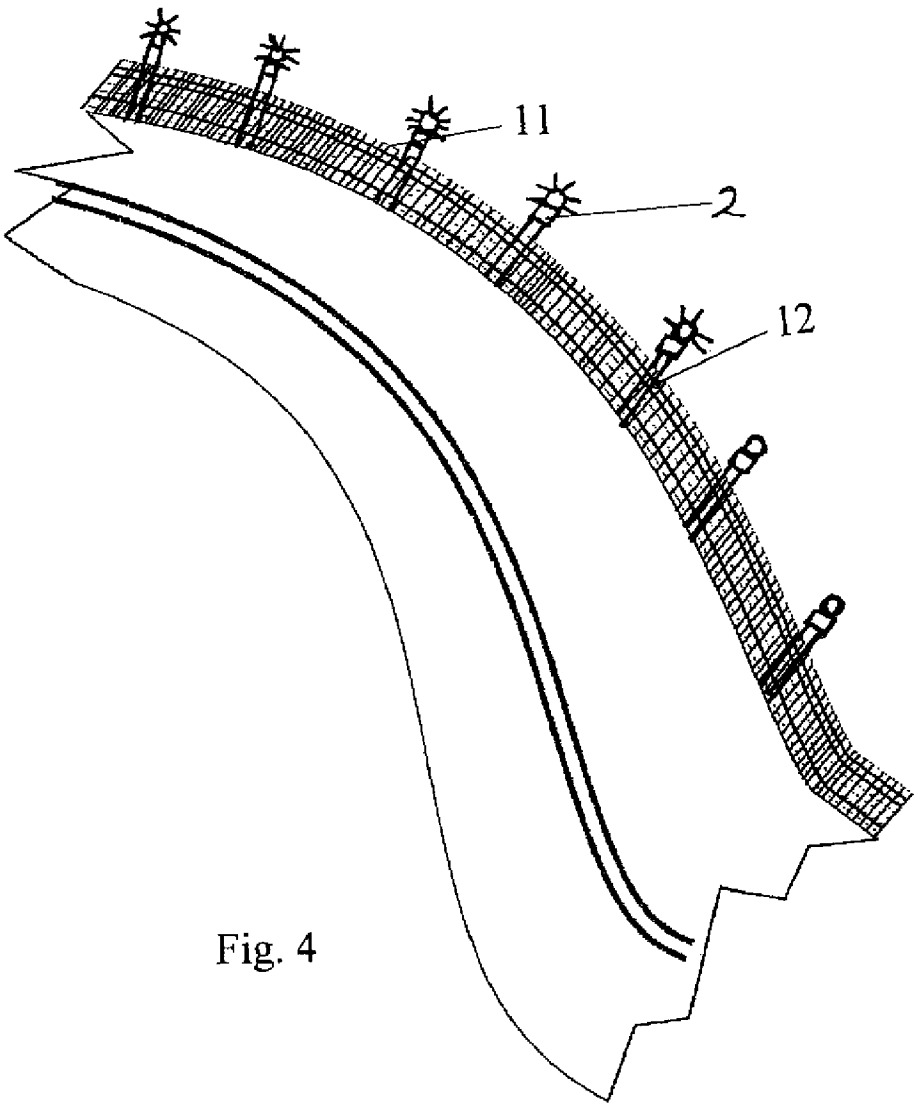
FIG. 4 is a fragmentary, perspective view of a fence according to an exemplary embodiment of the present invention with a horizontal retro-reflective tape extending horizontally at the roadside.
Figure 5:
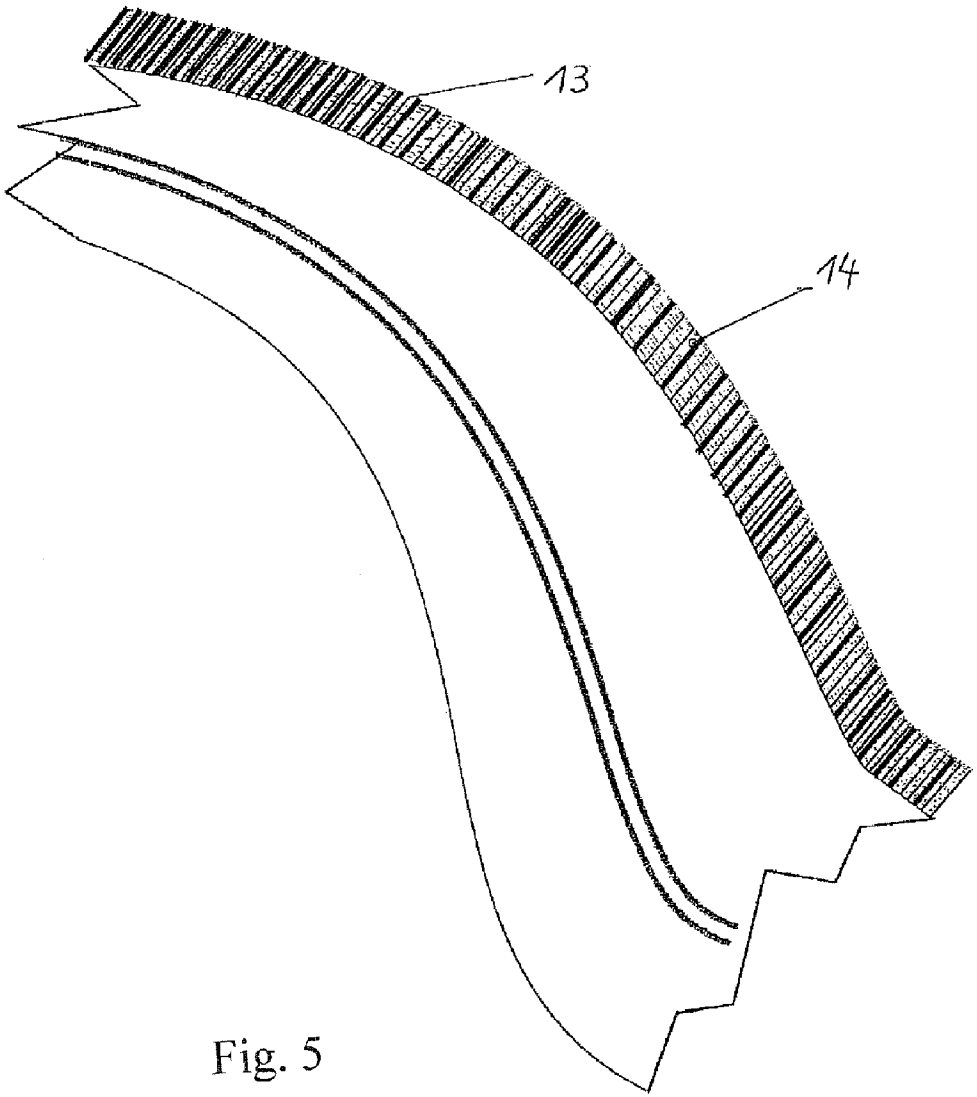
FIG. 5 is a fragmentary, perspective view of a fence according to an exemplary embodiment of the present invention with vertical retro-reflective tapes extending horizontally at the roadside.

Referring now to the figures of the drawings in detail and first, particularly to FIG. 4 thereof, there is shown a fence 11 wherein the direction of retro-reflective strips 12 is at least substantially horizontal. FIG. 5 shows, in comparison, a fence 13 wherein the direction of retro-reflective strips 14 is vertical.

Depending on the needs for which it is intended, the width of each woven (embedded) tape is in the range of between 1 mm to 1000 mm. Furthermore, the reflection color and elasticity of this tape is freely decided and can only be limited by the use for which each new product is intended.

The number of woven products that can be produced using this technology is very large. As an example, the new retro-reflective fence netting according to one embodiment of the invention is described hereinafter.

Figure 7:
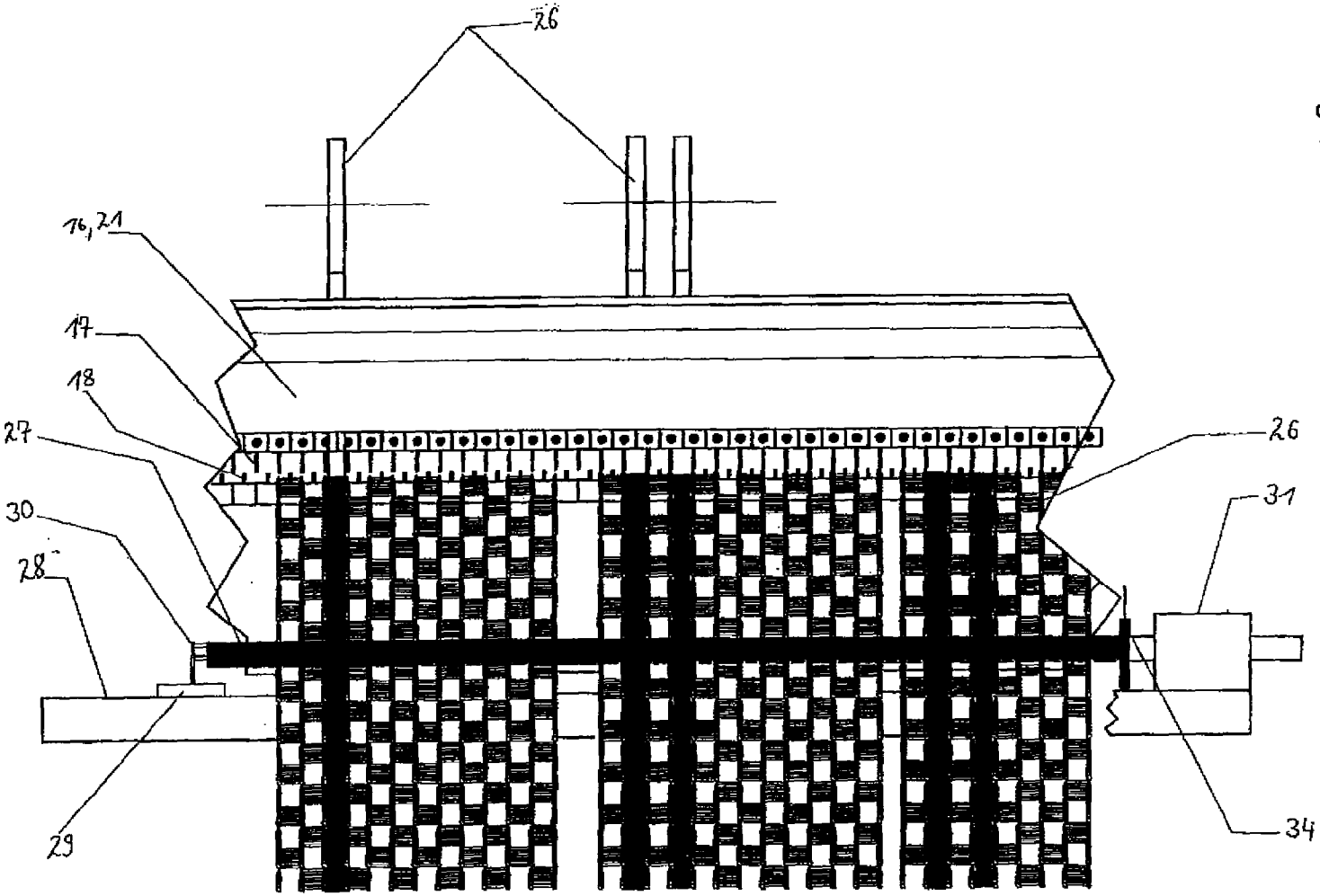
FIG. 7 a fragmentary elevational view of a netting having retro-reflective tapes extending in machine and in transverse direction.

This netting product is intended to be used as a fence for the preventive protection of road and building works and earthworks in general. The main weaving pattern used in this product is square weaving (FIG. 7). This means that it includes alternating square meshes in which one column of squares is fully colored, e.g., orange or red fibers so that by their color they warn of imminent danger, and the next column of squares is empty so that, on the one hand, it will be possible to weave the reflective tape there and, on the other hand, it will allow the wind to pass therethrough without causing a great force to be imparted on the fence. For this reason, it is not necessary to use particularly strong supports to keep the fence stable. One exemplary color of the retro-reflective tape that is woven in the squares is silver.

One exemplary method by which these meshes are produced is set forth in the following text.

Figure 6:
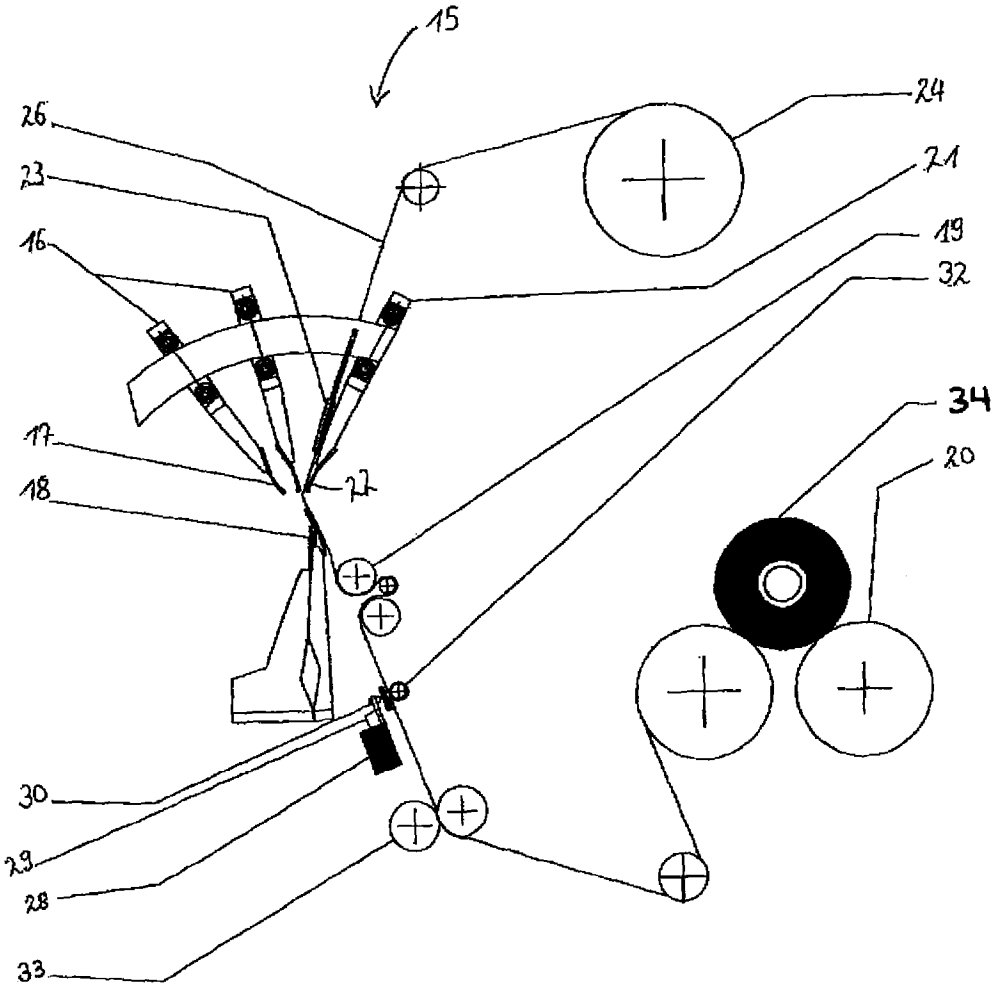
FIG. 6 is a side elevational view of a weaving machine according to an exemplary embodiment of the present invention for weaving a netting and attaching at least one tape extending in machine direction and/or at least one tape extending in transverse direction.

Using an existing weaving machine 15 (FIG. 6) that includes (in outline) two combs 16 with threading needles 17, a series of needles 18, an extender 19, and a spool winder 20, a netting is woven that may be used as a fence.

To manufacture the net where the retro-reflective tape 12 is embedded in a machine direction, some new materials have been added to the machine: an additional comb 21 with corresponding threading needles 22. The number of the threading needles 22 is equal to the number of tapes, a tape guide 23, and a locked shaft 24 where the tapes are placed.

Figure 3:
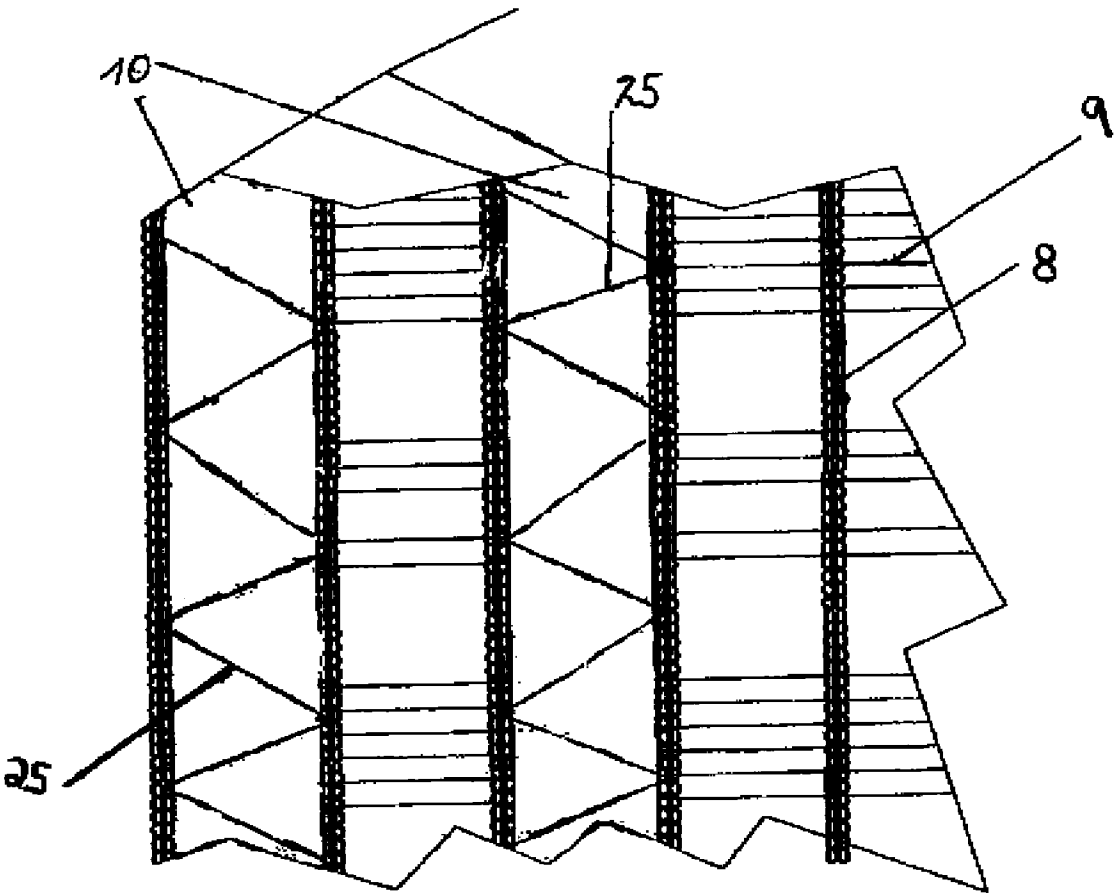
FIG. 3 is an enlarged, fragmentary, elevational view of a netting according to an exemplary embodiment of the present invention with a tape extending in machine direction where the tape is attached to the netting by a thread.

In operation, rolls of tapes are put on shaft 24 and, guiding the tape 10 according to FIG. 3, the tape 10 is passed through the tape guide 23 and, in this way, the tape 10 is touching the spot where the netting is woven. By pressing guide 23 of the tape 10 on the mesh, the tape 10 is dragged along by the netting and in this point of the weaving comb 21 with each equal number of threading needles 22 a thread 25 (FIG. 3) in zigzag pattern is woven on the reflective tape 10 or 26 (FIG. 7). In this manner, the tape 10, 26 is woven on the netting in the machine direction. With this method, the productivity of weaving machine 15 is not affected and it is possible to produce nettings with as many retro-reflective tapes as desired.

To manufacture meshes (fences) including tapes 27 extending in vertical direction with respect to the machine direction some additional parts are added to machine 15. A linear guide 28 (FIGS. 6, 7), which is a beam having edges reaching from one end of the weaving machine 15 to the other, is bearing a trolley 29 (FIG. 7) which has thereon two electromagnetic clamps 30, a soldering-bit having two jets 31 for the necessary thermo glue to stick the tape on the netting, a gluing shaft 32 (FIG. 6), shaft pair 33, razors and automatization, which includes a counter with which it is set how many meters a tape 27 will be inserted, and the PLC which sets all other operations.

In operation, the counter is set to desired distance between tapes, e.g., 3 meters. After entering the order, the trolley 29 where the clamps 30 are located moves towards the tape, one end of which is in a guide 28. The moment the clamps 30 reach the end of the tape, they close and the trolley 29 starts to move to the other side of the machine. At the same time, during the entire movement, the nozzles or jets 31 (FIG. 7) that are next to the tape guide (FIG. 7, position 34) spread the thermo glue on tape 27. With this method, tape 27 is guided where glue has been added vertically against the produced netting. During the entire movement of the trolley 29, the tape 27 is guided perpendicular to the production flow of the netting and parallel to its surface without touching it and in this way it is possible to keep production uninterrupted and keep tapes parallel to each other.

When tape 27 reaches the other edge of the machine, the shaft 32 rotates on its axis by 15°, for example. In this way, the tape 27 is pressed on the netting and is cut at the point or in the proximity of the point where the guide 34 is located. From this stage, the counter counts the 3 meters that have been set as an interval and, then, the system is ready to repeat the procedure. During production, the netting, along with the retro-reflective tape, reaches the shaft pair 33 where the tape 27 is pressed and is embedded on the netting. After the tape 27 is pressed, it is cut by razors and is ready to be rolled.

This innovation is easy to use and cost-efficient so that it can easily be adapted and, in various ways, even to existing mesh (the well-known orange or red extruded fence that are seen in road works).

Briefly, during production of the net before it is rolled, it passes through a shaft pair where the reflective tapes are attached to the netting by hot melt glue, for example. There can be one or more tapes parallel to the machine direction or in a direction opposite to the transverse direction. There are no limitations as to the width and the color of these tapes.

The result of using this product as a fence is that, in some roads, the passing drivers will be able to see very well the limits of the road because, the color, orange for example, offers a very intense contrast versus the surrounding area while the silver tapes reflect the light with an intense silver-white color. This combination can be visible from hundreds of meters away. At night and in bad weather conditions, the fence is very visible due to the retro-reflective effect from the vehicle headlights. This is because the reflective tapes create continuous bright silvery white lines on the fence, as far as the headlights of the vehicle can reach. This means that there is no need for special signaling lamps. After being set up, the fence will need no maintenance or supervision of its function because the retro-reflective tapes remain functional even after long time, e.g., a year.

With this proposed method it is possible to produce a series of new products for the preventive protection and safeguarding of different projects and objects. These materials are very cost efficient and effective.

I claim:

1. A protective fence for ensuring the security of persons or vehicles, comprising:

a protective net, comprising:

fibers of polyethylene woven with one another forming a netting having a square weaving pattern; and retro-reflective elements, wherein said retro-reflective elements are tapes and each of said tapes is positioned between two directly adjacent warps of said netting, wherein each of said tapes is removably held to said netting by at least one thread woven in a zigzag pattern across said tape between said two directly adjacent warps; and a plurality of fence-stabilizing supports attached to and supporting the net.

2. The fence according to claim 1, wherein:

said tapes extend in a netting extension direction; and said tapes are positioned at least one of parallel with and transverse to said netting extension direction.

3. The fence according to claim 1, wherein said fibers are at least one of woven and braided.

4. The fence according to claim 1, wherein said fibers are of a material selected from at least one of the group consisting of low density polyethylene, high density polyethylene, and a stressed polyethylene film.

5. The fence according to claim 1, wherein said netting is reinforced with at least one of reinforcement warps and reinforcement wefts.

6. The fence according to claim 1, wherein said fibers are extruded fibers.

7. The fence according to claim 1, wherein said tapes have a number and a size that is varied dependent upon a use of the net.

* * * * *

UNITED STATES PATENT AND TRADEMARK OFFICE

CERTIFICATE OF CORRECTION

PATENT NO. : 7,934,700 B2
APPLICATION NO. : 11/843884
DATED : May 3, 2011
INVENTOR(S) : Antonios Karatzis It is certified that error appears in the above-identified patent and that said Letters Patent is hereby corrected as shown below:

On the title page item [73]:
The assignee should read --Karatzis S.A.--

Signed and Sealed this
Nineteenth Day of July, 2011

David J. Kappos

David J. Kappos
*Director of the United States Patent and Trademark Office*